United States Patent [19]

Henry

[11] Patent Number: 4,522,402

[45] Date of Patent: Jun. 11, 1985

[54] TRIANGULAR PRISM GAME-PUZZLE

[76] Inventor: Rohan G. Henry, 1230 Walnut St., Newton, Mass. 02161

[21] Appl. No.: 466,978

[22] Filed: Feb. 16, 1983

[51] Int. Cl.[3] ..... A63F 9/08

[52] U.S. Cl. ..... 273/153 S

[58] Field of Search ..... 273/153 S, 281

[56] References Cited

U.S. PATENT DOCUMENTS

| | | | |
|---|---|---|---|
| 437,186 | 9/1890 | Farwell | 273/153 S |
| 822,862 | 6/1906 | McGraw et al. | 273/153 S |

FOREIGN PATENT DOCUMENTS

| | | | |
|---|---|---|---|
| EP54886 | 6/1982 | European Pat. Off. | 273/153 S |
| WO82/00101 | 1/1982 | PCT Int'l Appl. | 273/153 S |

*Primary Examiner*—Anton O. Oechsle

*Attorney, Agent, or Firm*—Cesari and McKenna

[57] ABSTRACT

A game-puzzle comprising four polygonal (e.g., triangular prism-shaped) members and a plurality of pairs of colored indicia members. One of the prism-shaped members serves as a central "stationary element"; each of the other triangular prism-shaped members is rotatably fastened to one of the faces of the stationary prism-shaped member. Each of the remaining faces of the rotatable prism-shaped members is provided with means for retaining up to two of the indicia members. In the exemplary embodiment, the indicia members are colored tabs having a flanged foot and the means for retaining the indicia members is a pair of slots in the faces of the prism-shaped members. The slots in neighboring prism-shaped members are aligned. The puzzle is solved by sliding tabs from one face of a prism-shaped member to an adjacent face of an adjacent prism-shaped member and by rotating prism-shaped members by 180° relative to each other intermediate such sliding actions.

9 Claims, 2 Drawing Figures

TRIANGULAR PRISM GAME-PUZZLE

FIELD OF THE INVENTION

This invention relates to the field of amusement devices and, in particular, a three-dimensional game or puzzle which is solved (i.e., unscrambled) by combinations of shifting and rotational movements of the puzzle pieces.

BACKGROUND OF THE INVENTION

Various types of games and puzzles have long been known, including among them puzzles in which the pieces can undergo only prescribed motions relative to each other, those pieces being first randomly scrambled and the object then being to solve the puzzle by unscrambling the pieces. In the unscrambled condition, the pieces have a known order. The unscrambling operation requires movement of the puzzle pieces relative to one another; the sequence and types of movements required can vary in degrees of difficulty. In such puzzles, it is also known to make the unscrambling of the puzzle more difficult by necessitating movements of puzzle pieces involving compound actions, as by requiring two pieces to be moved in a co-acting fashion or by causing two degrees of freedom (e.g., piece positions) to be altered by one motion; thus, an involved series of movements may be needed to accomplish what at first glance appears to be a simple transformation. The puzzle pieces may be slid over or around each other, rotated or rearranged by some combination of those motions. For example, there is the familiar "fifteen" puzzle such as shown in U.S. Pat. No. 1,459,937. In that type of puzzle fifteen square puzzle pieces are provided in a frame sixteen units square, leaving just one square empty. The object of the game-puzzle is to arrange the puzzle pieces in a desired pattern through a complicated series of horizontal and vertical shifting movements of the pieces. Another type of puzzle is the so-called Rubik's Cube device marketed by Ideal Toy Company; the same or a similar cube puzzle shown is in U.S. Pat. No. 3,222,072. That puzzle has as its object the rearrangement of the colors on the faces of the pieces through twisting rotations of groups of nine pieces at a time, all such nine pieces being in a particular row or column of the cube.

SUMMARY OF THE INVENTION

The present invention involves both the sliding motion of the "fifteen" type of puzzle and the rotation as used in the Rubik's Cube type of puzzle. The puzzle comprises four triangular prism-shaped members and a plurality of pairs of colored indicia members. One of the prism-shaped members serves as a central "stationary" element; each of the other triangular prism-shaped members is fastened to one of the faces of the stationary prism-shaped member, at least two of the former triangular prism-shaped members being rotatably fastened to the stationary prism-shaped member. In the aggregrate, the total assembly thus forms a larger triangular prism-shaped member. Each of the remaining faces of the rotatable prism-shaped members is provided with means for retaining up to two of the indicia members. In the exemplary embodiment, the indicia members are colored tabs of cardboard or plastic; each tab has a flanged foot and the means for retaining the indicia members is a pair of slots in the outer faces of the rotatable prism-shaped members, the flanged feet preventing the tabs from pulling out of the slots. At one end adjacent the neighboring prism-shaped member, each of the slots is open. Further, the slots in the neighboring prism-shaped members are aligned, so that the colored tabs may be slid from a slot on one of the prism members to a slot on the adjacent face of the adjacent prism member.

Five pairs of indicia members are provided, plus an eleventh unpaired indicia member. These may, for example be two tabs in each of five separate colors plus one tab in a different color. Two basic solution embodiments are shown, with options for embellishing each.

In a first embodiment, in "solved" form, each of the pairs of indicia members is retained on a separate face of one of the prism-members. Thus, initially, on five of the six exterior prism faces, a pair of colored tabs is provided in side-by-side slots. One the sixth face, one of the slots is left blank and a blank tab is inserted—i.e., a tab which does not match in color any other tabs. The puzzle is scrambled by rotating a prism member 180° on its rotational axis; sliding a tab into the empty slot and this process is repeated several times. Conversely, the same type of movement is used to unscramble the puzzle, with the object being to wind up with five of the six faces each having two tabs of the same color.

Optionally, to add an additional degree of difficulty, the faces of the prism-shaped members also may be color coded, such as by coloring each of them with a different color to match one of the pairs of indicia tabs. The solution to the puzzle can then be defined as the puzzle state wherein both tabs on each of five prism faces match in color the respective, predetermined (by color) prism face.

In a second embodiment, or as another option, instead of defining the solution as having two indicia tabs of the same color on the same face of one of the prism-shaped members, the two matching tabs may be required to be in aligned positions on adjacent faces of different prism-shaped members. In such an arrangement, the faces of the prism-shaped members may be divided into two side-by-side regions of differing colors, to match the colors of the tabs intended to be located there in the solved state.

As a further, option, one can identify each of the indicia members uniquely, rather than in pairs, as by adding an identifying number or design. The solution to the puzzle then may be defined as the puzzle state wherein in addition to both tabs on one or adjacent prism faces matching each other in some attribute (such as color), and even matching the prism face or half face (as by color), they must further be in specific preselected slots and even in preselected orientations (so that adjacent design components match up).

These and other features of the present invention will be more readily apparent from the following detailed description, which should be read in conjunction with the accompanying drawings. It should be understood, though, that this description is exemplary only and is not intended to exhaust the possibilities for puzzles constructed in accordance with the principles of this invention. Therefore, the invention is limited only as defined in the claims appended to the end of this description.

DETAILED DESCRIPTION

Figure 1:
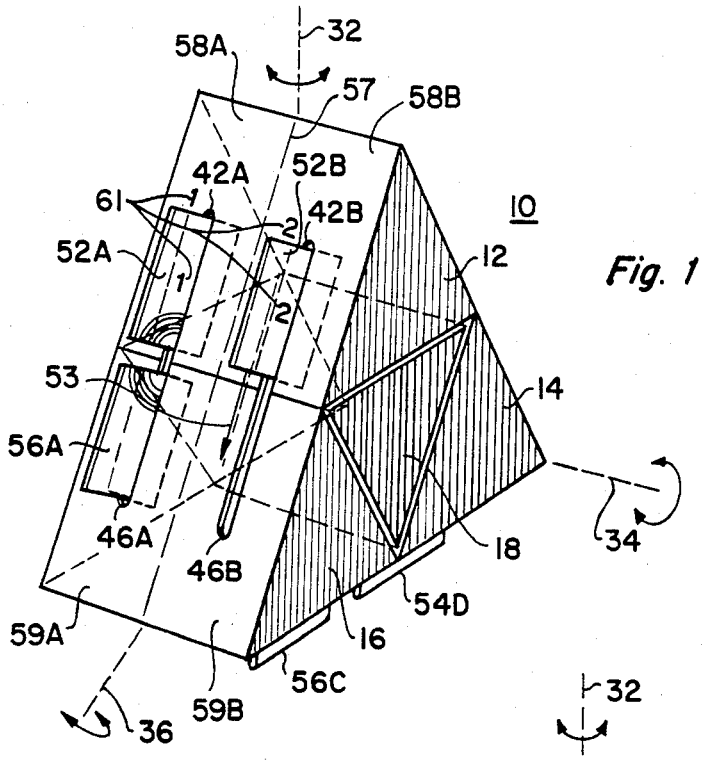
FIG. 1 is a pictorial illustration showing an isometric view of the puzzle of the present invention.

Referring now to FIG. 1, there is shown an isometric view of two illustrative embodiments of the invention. The puzzle, as will be seen, is formed from first, second, third and fourth triangular prism-shaped members 12, 14, 16 and 18, respectively.

As shown, the prism-shaped members are all, in cross-section, equilateral triangles of the size. Central prism member 18 may be considered to be a relatively stationary piece which provides a frame of reference. As will be seen from the cut away areas illustrated in FIG. 2, each of prism members 12, 14, and 16 is attached to central prism member 18 by a loose fitting rivet or like fastener (22, 24 and 26, respectively) which permits prism member 12, 14 or 16 to rotate relative to stationary prism member 18. The rotational axis for the prisms 12, 14 and 16 are indicated respectively by the dashed lines 32, 34 and 36. Each of the fasteners 22, 24 and 26 is placed at the center of the two mating faces of the prisms joined by the fastener.

A pair of slots is provided in each of the exterior faces of prisms 12, 14 and 16 (i.e., those faces not mated to prism 18), extending from an interior vertex of the prism member part way toward the exterior vertex, for retaining indicia members (i.e., flange-footed tabs) 52A–52D, 54A–54D, and 56A–56C. These slots are open at the former end and are closed at the latter end. All of the slots are equi-distance from the adjacent lateral edge of the associated prsim-member, so that each slot will line up with a slot on the neighboring prism face, regardless of how the prisms re rotated relative to each other. Thus, in FIG. 1, tab 52B, for example, may be slid in the direction of arrow 53 from slot 42B to slot 46B. That leaves slot 42B empty. It is then necessary to rotate either prism 12 or prism 16 in order to bring another tab opposite slot 42B; such other tab can then be moved into slot 42B, thereby changing the combination of tabs in the slots 42A and 42B on one face of prism 12.

Figure 2:
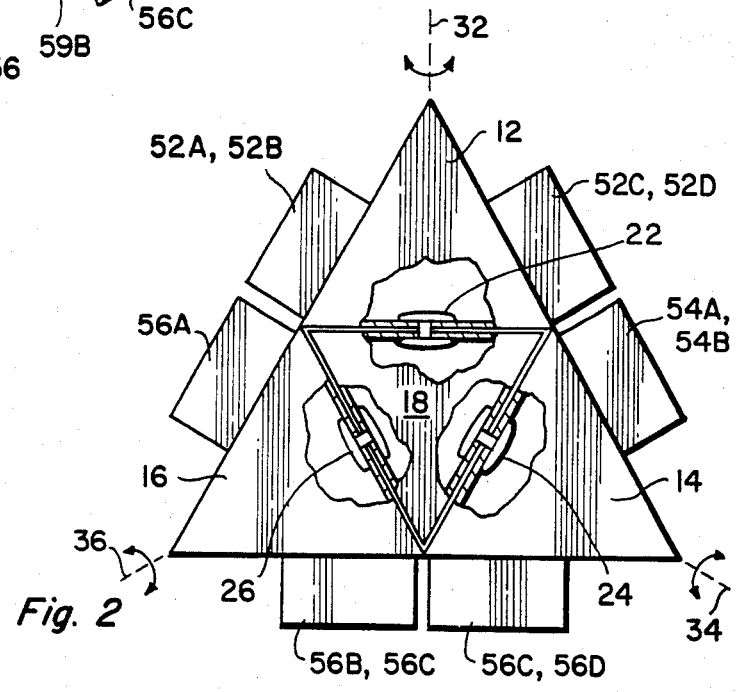
FIG. 2 is a "front" plan view the present invention, partially cut away to show the rotation-permitting fastening between the triangular prism-shaped members.

No coloring is indicated for the tabs in FIGS. 1 and 2 but it should be understood that, as indicated in the summary of the invention section above, it is intended that the tabs 52A–52D, 54A–54D and 56A–56C be colored or otherwise marked with some identifying criteria (e.g., numbers, designs, etc.) so there are five pairs of identical tabs and one tab not matching any of the others.

Optionally, each exterior face of the prisms 12, 14 and 16 also may be color coded. In a first embodiment, each of the prism faces may be made a solid color, to match the color of a pair of tabs intended to be stationed there when the puzzle is solved. In a second embodiment, or as another option, instead of each prism face being a solid color, the prism faces may be divided into two colored regions, side by side, and the solution may then be defined as the puzzle state wherein the two tabs of the same color are in aligned positions on adjacent faces of different prism-shaped members. This latter possibility is indicated in FIG. 1 by the dashed line 57, which is shown dividing adjacent faces of prism-shaped members 12 and 16 into two separately identified (e.g., separately colored) regions 58A, 58B and 59A, 59B, respectively.

An additional degree of complexity can be added by adding a unique identifier to each indicia member (i.e., colored tab). Each indicia member can then be required to be in a predetermined position on a specific prism-member face for the puzzle to be solved. These optional unique identifiers are indicated generally in FIG. 1 as numerical designators 61. Further, in the aforesaid second embodiment, wherein the prism faces are divided into two side-by-side colored regions, these identifiers can also comprise interlocking designs or the like which match up only when the indicia members have specific orientations, as represented by the patterns shown on tabs 52A and 56A.

It should now be apparent that numerous alterations, modifications and improvements may be made by or will occur to those skilled in the art. Such modifications, improvements and alterations are intended to be suggested by this description even if not expressly not indicated, and are intended to be within the scope of this invention. Accordingly, it is intended that the invention be limited only as set forth in the appended claims.

What is claimed as new and desired to be secured by Letters Patent of the United States is:

1. A puzzle-game comprising:

first, second, third and fourth triangular prism-shaped members;

a first face of each of the first, second and third triangular prism-shaped members being rotatably fastened, respectively, to the first, second and third prism faces of the fourth prism-shaped member;

a plurality of pairs of corresponding indicia members;

means for removably retaining no more than two indicia members on each of the second and third faces of the first, second and third prism-shaped members;

means for allowing only one of the indicia members to be moved at a time from one of said second and third faces of one of said first, second, and third prism-shaped-members to one of said second and third faces of an adjoining one of said first, second, and third prism-shaped members;

whereby a combination of successive movements of indicia members from a face of a prism-shaped member to an adjacent face of a neighboring prism-shaped member and rotation of prism-shaped members the puzzle may be solved and pairs of corresponding indicia members may be caused to be positioned in adjacent positions on the faces of the prism-shaped members.

2. The apparatus of claim 1 wherein the adjacent positions for a pair of indicia members are on one face of one of the prism-shaped members.

3. The apparatus of claim 1 wherein the adjacent positions for a pair of indicia members are on adjacent faces of a pair of prism-shaped members.

4. The apparatus of claim 1 wherein the means for removably retaining indicia numbers comprises a pair of slots disposed on each of the prism faces of the first, second and third prism-shaped members, such slots being disposed parallel to the end faces of the prism members and each slot being colinear with a slot on an adjacent face of another prism-shaped member, and the indicia members being elements adapted to be retained in said slots.

5. The apparatus of claim 4 wherein the indicia members are flanged-footed tabs adapted to be slid along the slots.

6. The apparatus of claim 5 wherein the corresponding indicia members of each pair are identified by a common physical attribute.

7. The apparatus of claim 6 wherein the corresponding indicia members are of the same color.

8. The apparatus of claim 7 wherein for each pair of corresponding indicia members, there is a corresponding face of one of the prism-shaped members, such corresponding face being of the same color as the color of the corresponding indicia members.

9. The apparatus of claim 8 wherein each indicia member has a unique identifying characteristic and one of the slots of the corresponding same-colored prism face is identified by a like identifier, whereby for the puzzle to be solved, both indicia members or pair of corresponding indicia members must be positioned on the corresponding face of the prism-shaped members and further, each of the indicia members is positioned in the slot identified by the same unique identifier as that indicia member.

* * * * *